United States Patent [19]

Book et al.

[11] Patent Number: 4,834,257

[45] Date of Patent: May 30, 1989

[54] REINFORCED WALL STRUCTURE FOR A TRANSFORMER TANK

[75] Inventors: William J. Book; John W. Hatfield, both of Jefferson City, Mo.

[73] Assignee: Westinghouse Electric Corp., Pittsburgh, Pa.

[21] Appl. No.: 131,704

[22] Filed: Dec. 11, 1987

[51] Int. Cl.[4] ..... B65D 7/42

[52] U.S. Cl. ..... 220/85 TC; 220/1 B; 220/71; 165/104.33

[58] Field of Search ..... 220/1 B, 3, 71, 72, 220/85 TC; 165/104.33, 130

[56] References Cited

U.S. PATENT DOCUMENTS

| | | | |
|---|---|---|---|
| 1,261,637 | 4/1918 | Sonneborn | 165/104.33 |
| 2,144,480 | 1/1939 | Brown | 220/85 TC |
| 3,168,777 | 2/1965 | Ridder et al. | 165/104.33 |
| 3,489,207 | 1/1970 | Miller | 165/104.33 |
| 3,741,292 | 6/1973 | Aakalu et al. | 165/104.33 |
| 4,201,523 | 5/1980 | Olofsson | 165/104.33 |
| 4,413,674 | 11/1983 | Avery et al. | 165/104.33 |
| 4,549,603 | 10/1985 | Shirai et al. | 165/104.33 |
| 4,745,966 | 5/1988 | Avery | 165/104.33 |

*Primary Examiner*—David T. Fidei

*Attorney, Agent, or Firm*—B. R. Studebaker

[57] ABSTRACT

A reinforced wall structure for a transformer tank characterized by a tank having opposite tank walls and braces on the walls for stiffening the walls against deflection. A transformer assembly including a transformer mounting end frame and a transformer within the end frame is mounted in the tank with the end frames adjacent to the braces so as to limit lateral movement of the assembly when an overcurrent condition occurs. A cooling fin assembly is mounted on each tank wall on the side opposite the braces.

5 Claims, 2 Drawing Sheets

REINFORCED WALL STRUCTURE FOR A TRANSFORMER TANK

BACKGROUND OF THE INVENTION

1. Field of the Invention

This invention relates to a reinforced wall structure for a transformer tank that is subjected to pressures within the tank occurring as the result of overcurrent conditions during operation of a transformer.

2. Description of the Prior Art

Tanks containing a transformer submerged in cooling fluid are normally subjected to overcurrent conditions, such as short circuits, across the secondary and load conductors. Heretofore, transformers, such as a three-phase distribution transformer, were comprised of a core/coil assembly which was mounted within a mounting or U-frame for holding the assembly intact during handling and/or shipping. The core/coil assembly together with the mounting frame were in turn mounted within a reinforcing frame when installed within a transformer tank. The function of the reinforcing frame was to limit or subdue any expansive movements of the transformer resulting from expansive pressures incurred by the transformer coils due to any overcurrent conditions such as short circuits. Because of the reinforcing frame, a larger tank was required to enclose the assembly of the transformer, mounting frame, and reinforcing frame, which in turn requires a larger volume of cooling fluid. Manifestly, a more costly transformer structure was involved. Competitively, a less costly transformer structure was necessitated.

SUMMARY OF THE INVENTION

In accordance with this invention a reinforced wall structure for a transformer tank is provided which comprises a tank having opposite tank walls, brace means on the walls for stiffening the opposite walls against deflection, a transformer assembly within the tank and extending between the brace means of the opposite walls, the brace means including rigid channels fixedly mounted on the inside surface of at least one of the walls, the transformer means including a transformer and transformer mounting frame and the frame including opposite end frame members adjacent to the rigid channels, the brace means also including packing material between the frame members and the channels to prevent initial movement of the transformer assembly, the channels being horizontally disposed, and a cooling fin assembly mounted on the outside of the walls opposite the rigid panels so as to reinforce the walls, whereby any expansion of the transformer assembly toward the opposite tank walls is limited by the brace means, side walls and fins.

DESCRIPTION OF THE PREFERRED EMBODIMENT

Figure 1:
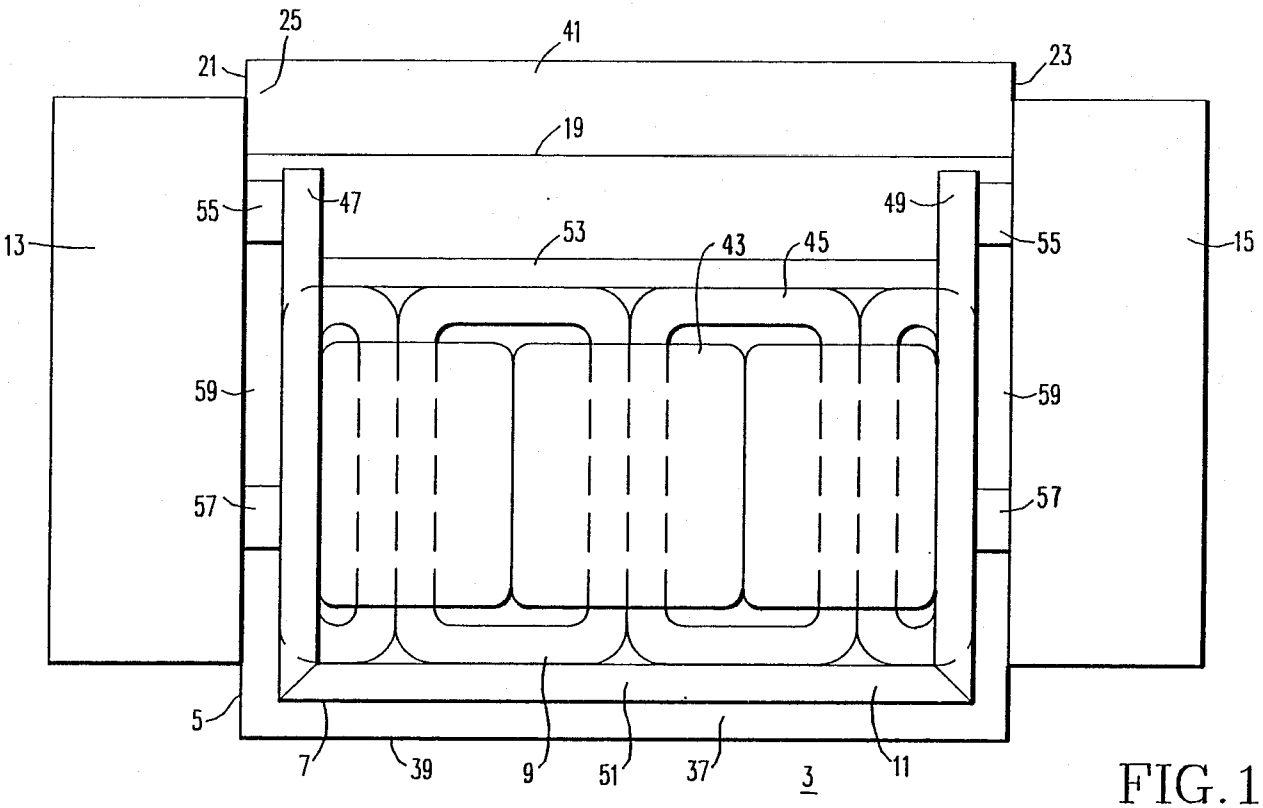
FIG. 1 is a vertical sectional view through a three-phase transformer.
Figure 2:
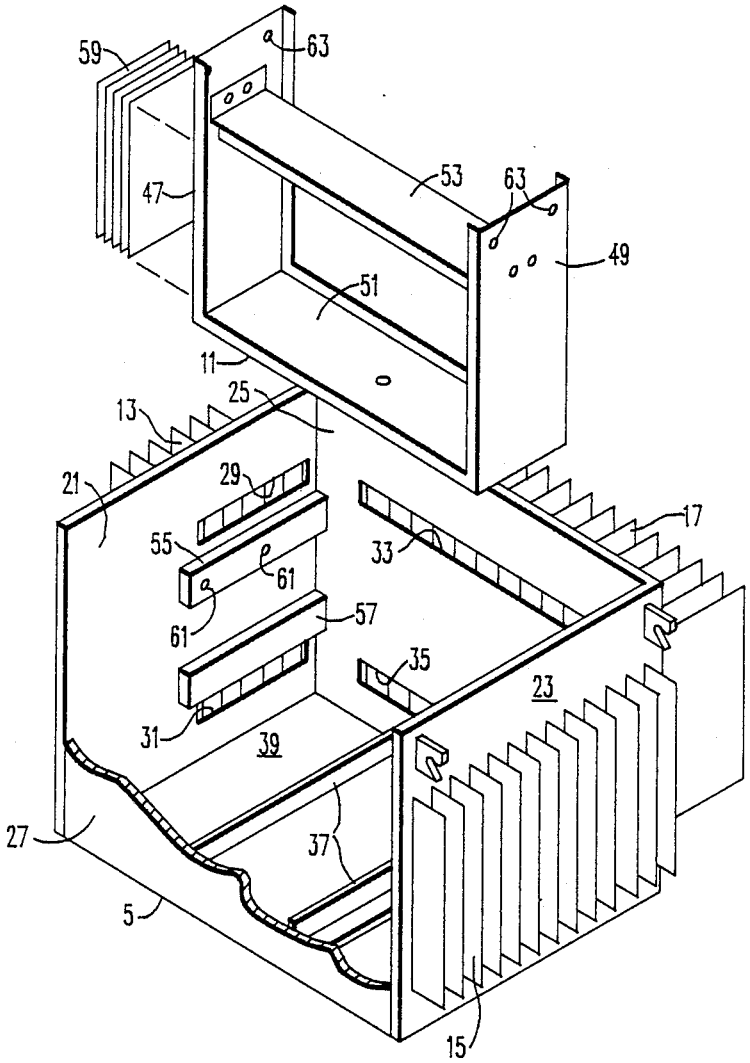
FIG. 2 is an exploded view of the support frame and tank of the transformer as shown in FIG. 1.

In FIG. 1 a transformer structure is generally indicated at 3 and it comprises a tank 5 which contains a transformer assembly 7 which, in turn, include a transformer unit 9 and a mounting frame 11. The transformer structure also includes a plurality of similar heat exchanger panels 13, 15, 17 extending from the end and side walls of the tank 5 (FIG. 2).

Although the tank 5 is disclosed as containing a transformer assembly 7, it is understood that other electrical apparatus that is operated and submerged within a cooling fluid is within the scope of this invention. The tank 5 contains a dielectric or cooling fluid having a level 19.

The tank 5 comprises a pair of opposite end walls 21, 23 and a pair of opposite side walls 25, 27. As shown in FIG. 2, the end walls include outlet and inlet openings 29, 31 in the end walls 21 and 23, and the side wall 25, include inlet and outlet openings 33, 35. The inlet openings 29, 33 enable the dielectric or cooling fluid at the level 19 to enter the several heat exchangers 13, 15, 17, and reenter the tank at the lower outlet openings 31, 35. As shown in FIG. 1 when the transformer assembly 7 is mounted within the tank 5, it is supported on suitable means, such as a pair of support members 37, on a bottom wall 39 of the tank and below a top wall or cover 41.

In accordance with this invention the transformer unit is a polyphase structure, such as three phase, including three similar coils 43 and four cores 45 of conventional construction. The transformer unit 9 is contained within the mounting frame 11 which is a U-shaped member comprised of end frames 47, 49 and a bottom frame 51 which are preferably integral. The mounting frame 11 also includes a removable top frame 53. When the frame members 47–53 are completely assembled, the core/coil assembly 43, 45 is rigidly retained in place with opposite ends of the top frame 53 secured to the upper ends of the end frames 47, 49 in a suitable manner such as bolts. When assembled the transformer assembly 7 is lowered into place between the end walls 21, 23.

More particularly, the transformer assembly 7 may be substantially centrally disposed, or positioned off-center as desired, between the end walls 21, 23 by brace means including a pair of upper and lower braces 55, 57 at each wall. In addition, the brace means includes packing material 59 between the braces 55, 57, and the respective walls 47 or 49 or both.

The braces 55, 57 are horizontally disposed in spaced relation on each end wall, and are secured in place such as by welding. Each brace 55, 57 may be provided with a plurality of holes 61 which are aligned with corresponding holes 63 on the corresponding end frames 47, 49. In another embodiment, the braces 55, 57 and the packing material 59 may be employed at only one end wall 21.

When the transformer assembly 7 is secured in place, the end frames 47, 49 are bolted tightly with aligned holes 63, 61 to prevent movement of the transformer assembly 7 with respect to the interior walls of the tank, and, more particularly, with respect to the end walls 21, 23. In addition, the packing material 59 is disposed between the corresponding end frames 47, 49 and the braces 55, 57. In this manner, the packing material 59 inhibits any movement whatsoever of the end frames 47, 49, when the coil/core assembly undergoes an overcurrent condition. The packing material is necessary in addition to the braces 55, 57 in order to avoid any initial minute movement of the transformer assembly 7. By avoiding any small or initial movement, shifting of the overall transformer assembly 7 and therefore destruction of the transformer is avoided.

Manifestly, the braces 55, 57 distribute any pressure applied during an overcurrent condition over the entire surfaces of the tank end walls 21, 23. The heat exchangers 13, 15, in addition to cooling the coolant fluid serve to reinforce the walls 21, 23 against deformation or destruction which otherwise might occur during an overcurrent condition in the transformer.

In conclusion, it is pointed out that the transformer structure of this invention significantly reduces the cost of a three-phase distribution transformer core/coil assembly by utilizing the tremendous mechanical strength of the side wall cooling fins or heat exchangers which in conjunction with the welded horizontal channel braces on the inside walls facilitate the distribution of the overcurrent forces evenly along the side walls. Finally, the use of a more simplified U-frame support assembly for the transformer permits the use of a smaller tank than was feasible with transformer tanks of prior construction which, by necessity, included the massive reinforcing frame.

What is claimed is:

1. A reinforced wall structure for a transformer tank, comprising:

(a) a tank having opposite tank walls;

(b) brace means including rigid channels on at least one wall stiffening the wall against deflection;

(c) a transformer assembly within the tank and extending substantially between the brace means on one or more of the opposite walls; said transformer assembly including a transformer mounting frame and the frame including opposite end frame members adjacent to the rigid channels; and (d) packing material between the frame members and the rigid channels to prevent initial movement of the transformer assembly, whereby any expansion of the transformer assembly toward the opposite tank walls is limited by the brace means.

2. The structure of claim 1 in which the brace means are mounted on both end walls.

3. The structure of claim 1 in which the rigid channels are horizontally disposed.

4. The structure of claim 1 in which a cooling fin assembly is mounted on the side of the walls opposite the rigid channels so as to reinforce the walls.

5. The structure of claim 1 in which the rigid channels are welded in place on their respective walls and the end frame members are bolted onto the rigid channels.

* * * * *